United States Patent [19]

Gustavsson

[11] Patent Number: 5,027,576

[45] Date of Patent: Jul. 2, 1991

[54] APPARATUS AND METHOD FOR PROVIDING A THROUGHGOING DUCT IN A RAISED SEAM JOINT METAL ROOF

[75] Inventor: Lars A. Gustavsson, Borlange, Sweden

[73] Assignee: Dobel BYGG AB, Borlänge, Sweden

[21] Appl. No.: 311,607

[22] Filed: Feb. 15, 1989

[51] Int. Cl.[5] ..... E04B 7/18

[52] U.S. Cl. ..... 52/748; 52/200; 52/537

[58] Field of Search ..... 52/200, 478, 537, 748

[56] References Cited

U.S. PATENT DOCUMENTS

| | | | |
|---|---|---|---|
| 3,828,494 | 8/1974 | Uhrhane et al. | 52/537 |
| 4,014,148 | 3/1977 | Harter | 52/537 X |
| 4,361,998 | 12/1982 | Ellison et al. | 52/520 |
| 4,420,913 | 12/1983 | Long et al. | 52/57 |
| 4,467,586 | 8/1984 | Long et al. | 52/748 |
| 4,497,151 | 2/1985 | Simpson et al. | 52/520 |
| 4,559,753 | 12/1985 | Brueske | 52/200 X |

FOREIGN PATENT DOCUMENTS

| | | | |
|---|---|---|---|
| 2856835 | 7/1980 | Fed. Rep. of Germany | 52/200 |

*Primary Examiner*—Carl D. Friedman

*Attorney, Agent, or Firm*—Nils H. Ljungman

[57] ABSTRACT

An arrangement for sealing an opening in a roof deck by mounting a baffle plate in the roof deck so as to provide a throughgoing ducting channel, the roof deck having at least one raised seam joint intersecting the opening, the baffle plate being dimensioned such that it extends beyond the periphery of the opening in substantially all directions thereby defining a zone of overlap which extends around substantially the entire periphery of the opening, the arrangement including a capping member for capping and sealing the area where the baffle plate, the raised seam joint and the opening converge, a backing and stiffening member for being positioned on the opposite surface of the roof deck from the baffle plate and at least partially within the zone of overlap, and a fastening device for extending through and securing together the capping member, the baffle plate, the roof deck and the backing and stiffening member within the zone of overlap.

19 Claims, 7 Drawing Sheets

APPARATUS AND METHOD FOR PROVIDING A THROUGHGOING DUCT IN A RAISED SEAM JOINT METAL ROOF

BACKGROUND OF THE INVENTION

1. Field of the Invention

The present invention relates to an apparatus and method for sealing an opening provided in a sheet metal roof which consists of substantially flat panels joined together by raised seams, that is a "standing seam" roof. More particularly, the invention relates to an apparatus and method for installing, in a substantially watertight manner, a baffle plate having a throughgoing ducting channel (e.g., a chimney or chimney flashing, a ventilation shaft, etc.) on a sheet metal roof having raised seam joints.

2. Description of the Prior

U.S. Pat. No. 4,361,998 Dec. 7, 1982 to Ellison et al, U.S Pat. No. 4,497,151 issued Feb. 5, 1985 to Simpson et al both relate to raised seam roofs in which the seams comprise a snaplock arrangement that secures a resilient sealant strip. The roofs are secured to the underlying structure by means of clips that are fixed to the roof by means of the snaplock arrangement of the raised seams.

U.S. Pat. No. 4,420,913 issued Dec. 20, 1983, to Long, et al and entitled "Roof Ridge Structure and System" relates to an apparatus and method for covering the ends of the vertically upstanding seams joining the panels making up the standing seam roof.

The three abovementioned patents are hereby expressly incorporated by way of reference as if their contents were set forth fully herein.

In the area of roof construction (i.e., both original roof construction and the retrofitting of a new roof deck or a new external roof surface to an existing building), there arises the problem of joining the roof in a watertight manner to ducting passages which must pass through the roof deck, for example, ventilation chimneys, flues and the like. Normally, this is accomplished using a fitting (e.g., such as flashing) which is sealed against the outer surface of the roof. Generally, such fittings are manufactured in a shop, which can cause problems due to the fact that the fitting has to accomodate both the actual opening (e.g., a ventilation shaft, a chimney, a supporting member for an antenna or member for supporting an additional structure above the roof deck), as well as the peculiarities of construction of the roof deck itself. During the renovation or resurfacing of a roof deck, the situation is aggravated by the fact that the installation must be accommodated to the existing construction which cannot be moved sideways and adjusted to fit the new roof.

OBJECTS OF THE INVENTION

One object of the present invention is the provision of an apparatus and method for the installation and integration into a standing seam metal roof deck of a baffle plate having a throughgoing ducting channel (e.g., a ventilation shaft) in such a manner that the baffle plate may be easily and readily installed on the roof deck, and in such a manner that the structural integrity and rigidity of the roof deck and the standing seams thereof will not be impaired.

Another object of the present invention is the provision of an apparatus and method for the installation of such a baffle plate on such a roof deck in an easy and readily accomplished manner which nonetheless provides a weatherproof seal against the elements and provides such a seal also if the roof is horisontal or nearly horisontal.

SUMMARY OF THE INVENTION

In one aspect, the invention features an arrangement for sealing an opening in a roof deck by mounting a baffle plate adjacent said roof deck so as to provide a throughgoing ducting channel through said roof deck, said roof deck having first and second surfaces and comprising a plurality of panels joined edgewise by at least one raised seam joint projecting from said first surface of said roof deck, said opening in said roof joint intersecting said at least one raised seam joint at at least one portion, said baffle plate being provided with throughgoing ducting means for defining a passage therethrough, said baffle plate being dimensioned such that, when said baffle plate is placed on one of said first and second surfaces of said panels of said roof deck, said baffle plate extends beyond the periphery of said opening in said panels of said roof deck to thereby define a zone of overlap of said baffle plate with said panels of said roof deck, said zone of overlap extending around a substantial portion of the periphery of said opening in said panels of said roof deck, and said baffle plate being readily reducible in at least a portion of one dimension of extension about said intersection of said opening in said panels and said at least one raised seam joint, said arrangement comprising:

capping means for capping and sealing an area of convergence of: said baffle plate, said at least one raised seam joint and said opening in said panels;

backing and stiffening means for being positioned against said second surface of said panels;

said backing and stiffening means for being positioned opposite said baffle plate when said baffle plate is positioned against said first surface of said panels;

said backing and stiffening means also for being positioned at least partially within said zone of overlap; and fastening means for extending through and securing together: said capping means, said baffle plate, said panels and said backing and stiffening means within said zone of overlap.

In another aspect, the invention features an arrangement for sealing an opening in a roof deck by mounting a baffle plate in said roof deck so as to provide a throughgoing ducting channel through said roof deck, said roof deck having first and second surfaces and comprising a plurality of panels joined edgewise by at least one raised seam joint projecting from said first surface of said roof deck, said opening in said roof joint intersecting said at least one raised seam joint at at least one portion, said baffle plate being provided with throughgoing means for defining a passage therethrough, said baffle plate being dimensioned such that, when said baffle plate is placed on one of said first and second surfaces of said panels of said roof deck, said baffle plate extends beyond the periphery of said opening in said panels of said roof deck in at least one direction of thereby define a zone of overlap of said baffle plate with said panels of said roof deck, said zone of overlap extending around a substantial portion of the periphery of said opening in said panels of said roof deck, and said baffle plate being readily reducible in at least one portion of one dimension of extension about said intersection of said opening in said panels and said at least one raised seam joint, said arrangement comprising:

capping means for capping and sealing an area of convergence of: said baffle plate, said at least one raised seam joint and said opening in said panels;

an elastomeric material for being positioned between said capping means and said at least one raised seam joint; and fastening means for extending through and securing together: said capping means, said baffle plate and said panels within said zone of overlap.

In yet another aspect, the invention features a method for sealing an opening in a roof deck so as to provide a throughgoing ducting channel through said roof deck, said roof deck having first and second surfaces and comprising a plurality of panels joined edgewise by at least one raised seam joint projecting from said first surface of said roof deck, said opening in said roof deck intersecting said at least one raised seam joint at at least one portion, said method comprising the steps of:

providing a baffle plate, said baffle plate being provided with throughgoing ducting means for defining a passage therethrough, said baffle plate being dimensioned such that, when said baffle plate is placed on one of said first and second surfaces of said panels of said roof deck, said baffle plate extends beyond the periphery of said opening in said panels of said roof deck in substantially all directions to thereby define a zone of overlap of said baffle plate with said panels of said roof deck, said zone of overlap extending around a substantial portion of the periphery of said opening in said panels of said roof deck, and said baffle plate being readily reducible in at least a portion of one dimension of extension about said intersection of said opening in said panels and said at least one raised seam joint;

reducing said baffle plate in said at least one dimension of extension about said intersection of said opening in said roof deck and said at least one raised seam joint;

fitting said baffle plate against said first surface of said roof deck such that said reduced dimension of said baffle plate partially surrounds said at least one raised seam joint at said intersection of said at least one raised seam joint and said opening in said roof deck;

installing capping means for capping and sealing an area of convergence of: said baffle plate, said at least one raised seam joint and said opening in said panels;

positioning backing and stiffening means against said second surface of said panels, opposite said baffle plate when positioned against said first surface of said panels;

said backing and stiffening means being at least partially disposed within said zone of overlap; and securing fastening means for extending through and securing together: said capping means, said baffle plate, said panels and said backing and stiffening means within said zone of overlap.

In still another aspect, the invention feataures a method for sealing an opening in a roof deck so as to provide a throughgoing ducting channel through said roof deck, said roof deck having first and second surfaces and comprising a plurality of panels joined edgewise by raised seam joints said, raised seam joints comprising snaplock arrangements, said opening in said roof deck intersecting at least one of said raised seam joints at at least one portion, said method comprising the steps of:

providing a baffle plate, said baffle plate being provided with throughgoing ducting means for defining a passage therethrough, said baffle plate being dimensioned such that, when said baffle plate is placed on said panels of said roof deck, said baffle plate extends beyond the periphery of said opening in said panels of said roof deck in substantially all directions to thereby define a zone of overlap of said baffle plate with said panels of said roof deck, said zone of overlap extending around a substantial portion of the periphery of said opening in said panels of said roof deck, and said baffle plate being readily reducible in at least a portion of one dimension of extension about said intersection of said opening in said panels and said at least one raised seam joint;

reducing said baffle plate in said at least one dimension of extension about said intersection of said opening in said roof deck and said at least one raised seam joint;

fitting, sealing, and securing said baffle plate against said roof deck such that said reduced dimension of said baffle plate partially surrounds said at least one raised seam joint at said intersection of said at least one raised seam joint and said opening in said roof deck;

cutting away a portion of said snaplock arrangement at said at least one raised seam joint at the end of said seam joint adjacent said opening in said roof deck;

installing capping means for capping and sealing an area of convergence of said baffle plate, said at least one raised seam joint and said opening in said panels such that said capping means covers the snaplock lacking part of the raised seam.

DESCRIPTION OF THE PREFERRED EMBODIMENTS

Figure 1:
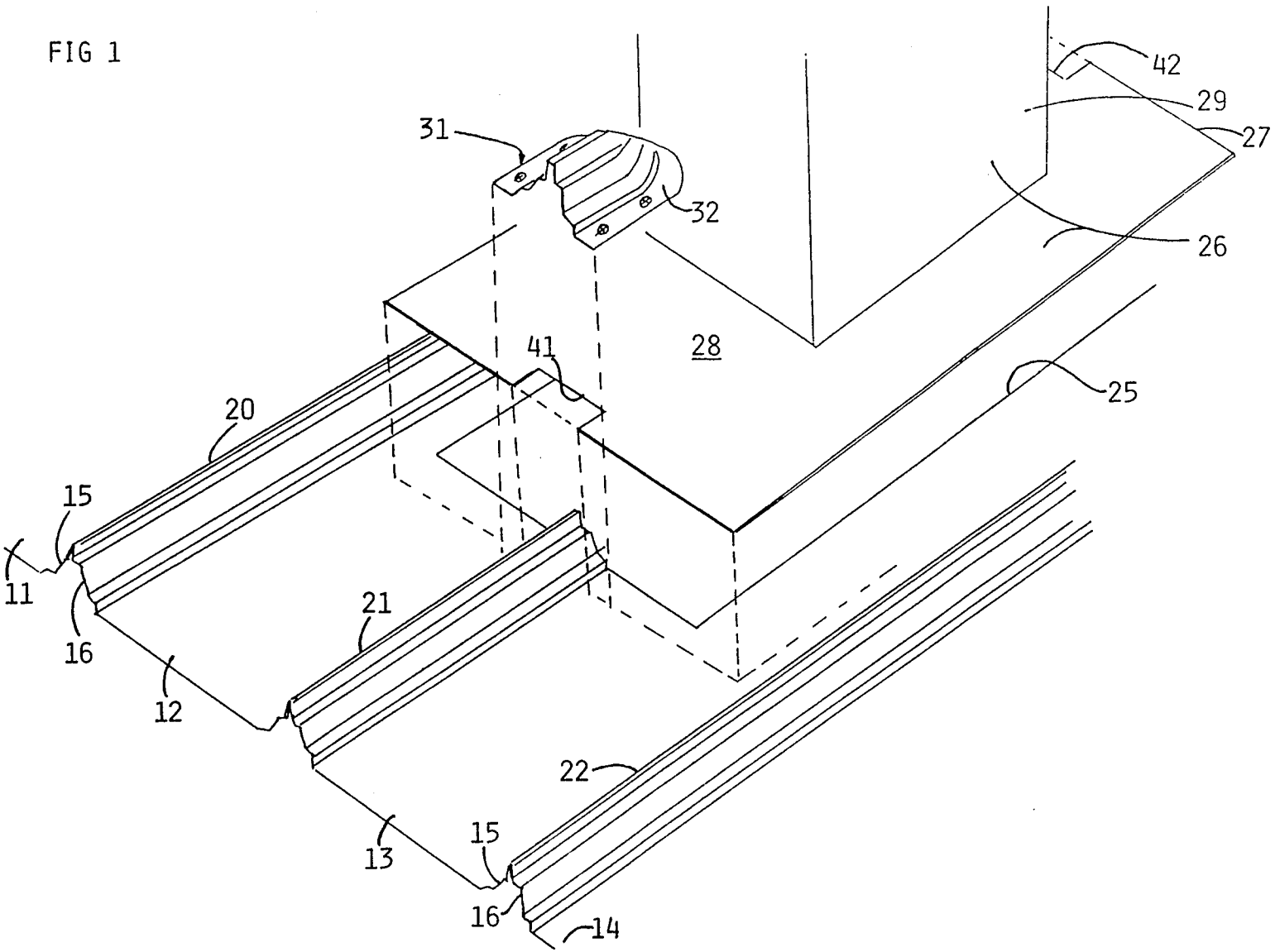
FIG. 1 is an exploded isometric view of a baffle plate being installed on a raised seam metal roof using an arrangement and a method according to the invention.

Referring first to FIG. 1, a roof deck generally includes a plurality of substantially parallel roof panels 11, 12, 13 and 14 which are joined edgewise by raised seam joints 20, 21 and 22. An opening 25 has been formed in the roof deck which intersects at least one of the raised seam joints, i.e., joint 21, and a fitting 26 is to be mounted over opening 25 so as to seal opening 25 and provide a throughgoing ducting channel, such as for a chimney, through the roof deck. The fitting 26 generally includes, in the illustrated embodiment, a flat portion such as a baffle plate 28 and a vertically surrounding portion 29 extending therefrom.

As shown most clearly in FIG. 1, baffle plate 28 extends beyond the periphery of opening 25 so as to create a zone of overlap between baffle plate 28 and the roof deck, as shown most clearly by the dotted lines in FIG. 1.

Also shown in FIG. 1 are reduced ("cutout") portions 41 and 42 provided in baffle plate 28 to accommodate and partially surround the area of intersection of raised seam joint 21 and opening 25.

The arrangement for sealing the opening 25 in the roof deck also generally includes, for each intersection of a raised seam joint such as 21 with opening 25, a cap member 31 having a peaked central portion which is generally dimensioned and contoured to fit over and lie substantially flush against the exposed upper surface of the raised seam joint 21 in the area where it intersects with opening 25 as will be described with reference to FIG. 1. Cap member 31 is provided with a substantially flat horseshoe shaped flange portion 32 having throughgoing holes for accepting sheet metal screws or the like. One end of cap member 31 is open, and the opposing end, in the embodiment of FIGS. 1 and 2, is provided with a rounded nose portion.

Figure 2:
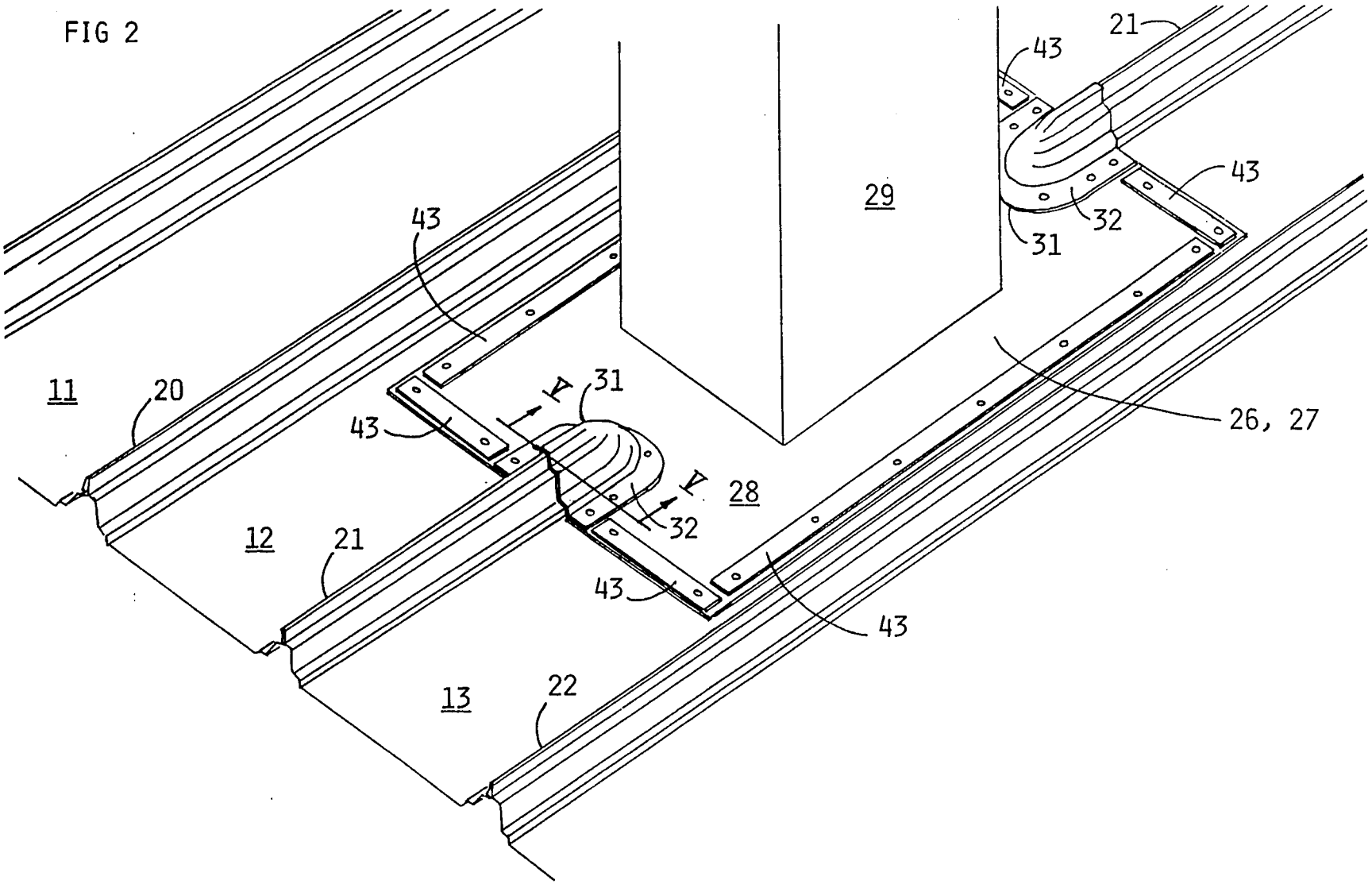
FIG. 2 is an isometric view of the same baffle plate installed on the same raised seam metal roof according to a first embodiment of the invention.

Referring now to FIG. 2, showing the baffle plate 28 installed, a plurality of clamping force distributing strips 43 are secured about the periphery of baffle plate 28 in the zone of overlap described above by fastening means, for example, a multiplicity of self tapping sheet metal screws extending through distribution strips 43, baffle plate 28, panels 12 and 13 and additionally backing and stiffening means disposed on the lower surface of the roof deck and described more fully hereinafter.

Figure 3:
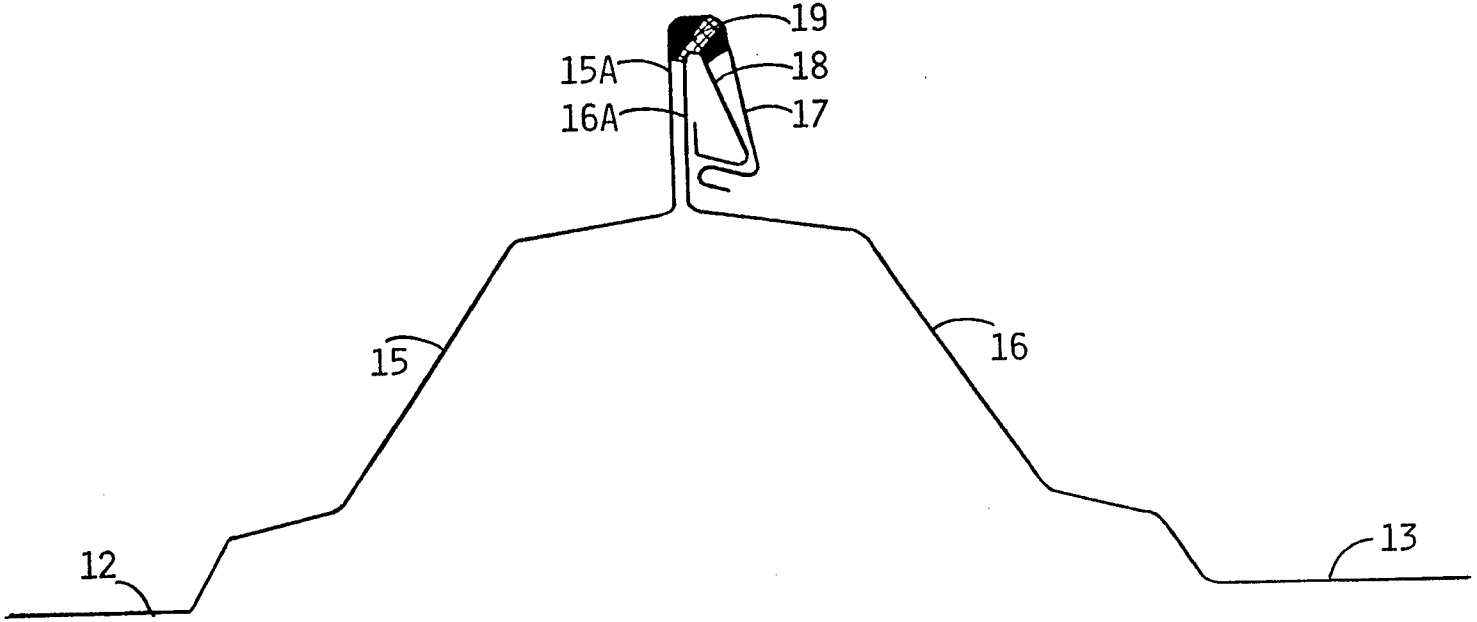
FIG. 3 is a sectional schematic view of a raised seam joint of a metal roof contemplated for use in conjunction with the present invention.
Figure 5:
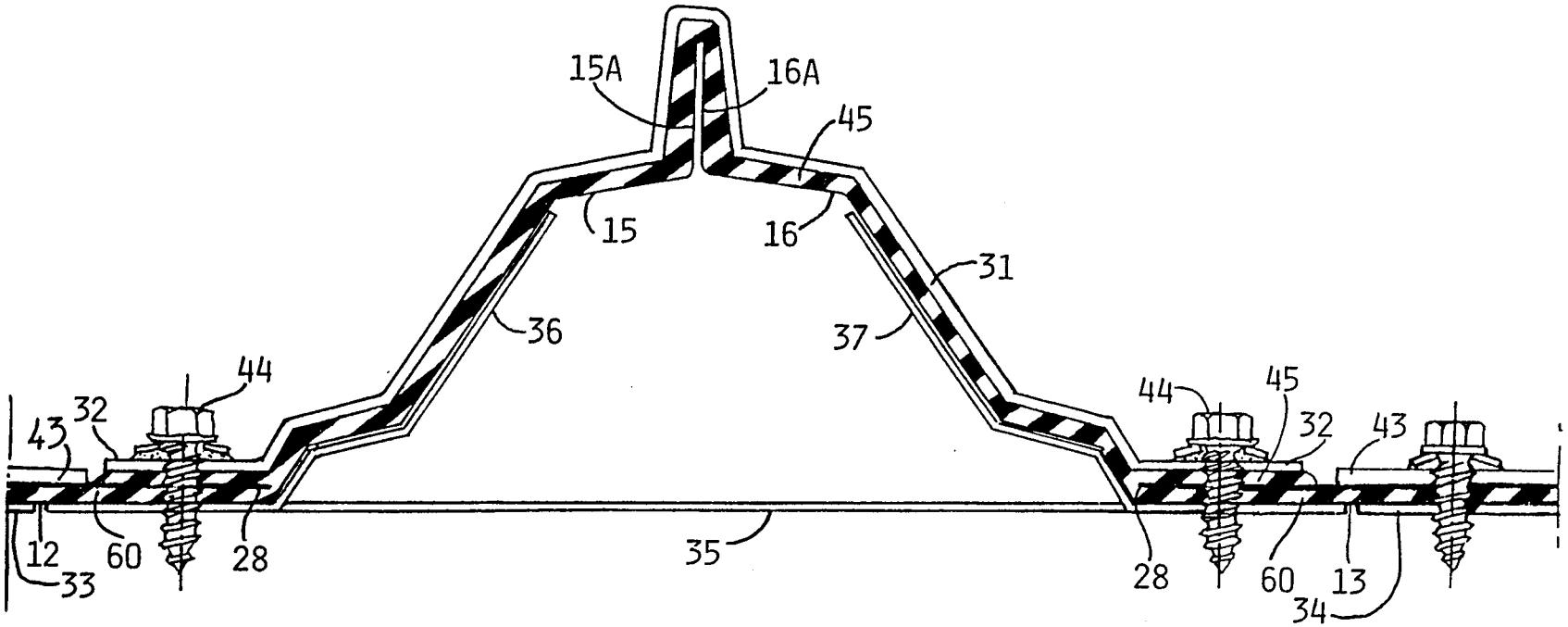
FIG. 5 is a cross-sectional view, along the section V—V indicated in FIG. 2, through a cap member, a baffle plate, and a raised seam joint adjoining adjacent sheet metal roof panels, together with additional sealing and attachment elements, as described hereinafter.

Referring now to FIG. 3, which schematically shows a raised seam of a metal roof deck of a type contemplated for use in conjunction with the present invention, panels 12 and 13 include upraised and contoured edge portions 15 and 16, respectively. Raised edge profiles 15 and 16 have parallell parts 15*a* and 16*a* respectively which end in formed edge configurations 17 and 18, respectively, substantially as shown. It will be appreciated that with the formed edge configurations 17 and 18 substantially as shown, roof panels 12 and 13 may be snappingly interlocked with one another. Thus, the edge configurations 17 and 18 form a snaplock arrangement. Preferably, the female edges 15*a* 17 of roof panels 12 and 13 will be provided with a sealant 19 preferably a factory installed foamed, resilient and adhesive rubber-like strip led configuration. In the conventional way shown in the abovementioned patents, the roof is secured to the underlying structure by means of non-illustrated clips that extend into the seam and are bent over the male edge profile 18. Adjacent the opening 25, a portion of the edge configurations 17 and 18 is cut away so that the seam will be fully symmetrical as can be seen in FIG. 5. The cap member 31 is adapted to this symmetrical portion of the seam as can also be seen in FIG. 5. The cut-away edge portion can for example be 1–3 inches long.

Figure 4:
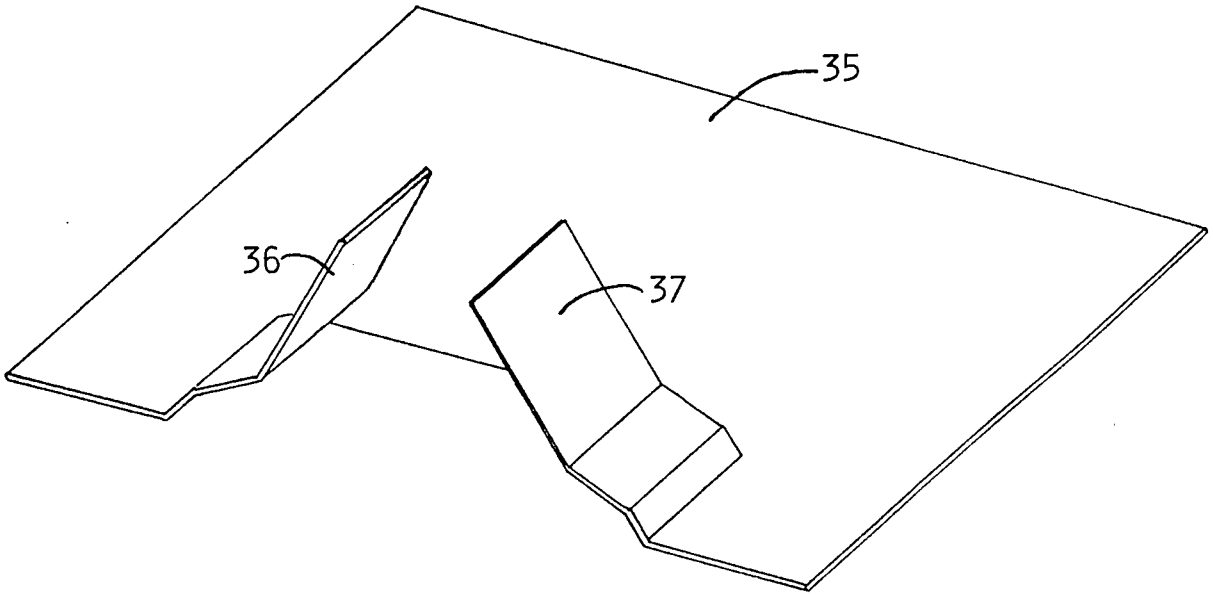
FIG. 4 is an isometric view of a backing plate.

Referring now to FIG. 4, a backing and stiffening member 35, which, during installation, is located on the lower surface of the roof deck and positioned adjacent the intersection of raised seam joint 21 and opening 25, is preferably made from a substantially flat metal plate, at one edge of which two cuts have been made in the form of a "T" so as to form two tab portions 36 and 37. As shown in FIG. 5, tab portions 36 and 37 have been deformed to project beyond the generally flat surface of backing and stiffening member 35, and have a plurality of angularly related surfaces which correspond to the interior surfaces of the raised seam joints, e.g., 20, 21 and 22, of the roof deck. Backing and stiffening member 35 serves a number of important functions: it serves to stiffen the flat planar portions of roof panels 12 and 13 where their structural integrity has been disrupted by the provision of opening 25; it serves as a backing member on the under surface of the roof deck into which fastening means, such as self tapping sheet metal screws, may be inserted; and, through the incorporation of upstanding tab portions 36 and 37, it structurally reinforces raised seam joint 21 where it has been weakened by the provision of opening 25.

It will be appreciated that a raised seam joint such as 21, if it is substantially continuous, has a relatively high degree of structural rigidity. However, its structural rigidity is substantially weakened at an end point such as is caused by opening 25. Backing and stiffening member 35 serves to reinforce this relatively weakened portion of raised seam joint 21 and stiffen it against possible damage.

FIG. 5 is a cross-sectional view, along the section V—V indicated in FIG. 2, through cap member 31 and baffle plate 28 installed on the roof deck. Backing and stiffening member 35 is shown extending across the raised seam joint 21 made up of raised edge portions 15 and 16 of roof panels 12 and 13, respectively. Upstanding tab portions 36 and 37 project into raised seam joint 21 and substantially conform to the interior angles and surfaces thereof.

A sealing agent, preferably a strongly adhesive, flowable butyl rubber strip 45 (possibly factory installed) within the interior of cap member 31 provides weatherproofing both between the cap and the upstanding seam referred to as 21 in FIGS. 1 and 2 and as 15, 16 in FIG. 5 and between the horse shoe shaped flange portion 32 of the cap 31 and the baffle plate 28. Flange portions 32 of cap members 31 are secured to roof panels 12 and 13 by the provision of self tapping sheet metal screws 44 which pass through cap member 31, butyl rubber strip 45, baffle plate 28, roof panels 12 and 13 and backing and stiffening member 35. Pressure distribution strips 43 are also shown, as well as additional backing and stiffening members 33 and 34 which may be disposed about opening 25 in the zone of overlap. As shown in FIG. 2, fastening means, for example, self tapping sheet metal screws, pass through distribution strips 43, baffle plate 28, roof panels 12 and 13 and backing strips 33 and 34. The self tapping screws take firm grip in the backing members, 33, 34 35. The backing members 33, 34, 35 should be thick enough to provide firm grips for the screws, but preferably not so thick that they prevent the use of self tapping screws.

A sealing agent, preferably butyl rubber strips 60 are interposed between baffle plate 28 and roof panels 12 and 13 in the above described zone of overlap.

It should be noted that backing and stiffening member 35 serves to minimize distortion of raised seam joint 21 when cap member 31 and butyl rubber strip 45 are secured and fastened thereover.

The step of a preferred mode of mounting the fitting 26 to the roof panels 12, 13 will now be described by way of example.

a The hole 25 is cut.

b About two inches of the snaplock forming seam edges 17, 18 are cut away.

c The backing elements 35 are put into place as well as the backing elements 33, 34 so that the roof panels are backed substantially around the entire hole 25.

d The cuts 41 in the baffle plate 28 of the fitting 25 are made.

e The sealing strips 60 are placed onto the underside of the baffle plate 28 and the baffle plate is put in place.

f The caps with their sealants 45 are so positioned that they abut the ends of the seam edges 17, 18.

g The pressure distributing strips 43 are put in place and self tapping screws are secured into the holes in the pressure distributing strips 43 and in the caps 31 to take firm grips in the backing elements 33, 34, 35. In FIG. 5 self tapping but not self boring screws are shown. Thus, holes must be drilled for the screws, alternatively, self boring screws can be used.

h Finally, the joint between the cap 31 and the seam edges 17, 18 should be visually checked and, if necessary, additional butyl rubber should be put into the joint to secure tightness. It is appreciated that this joint can be visibly checked.

Figure 6:
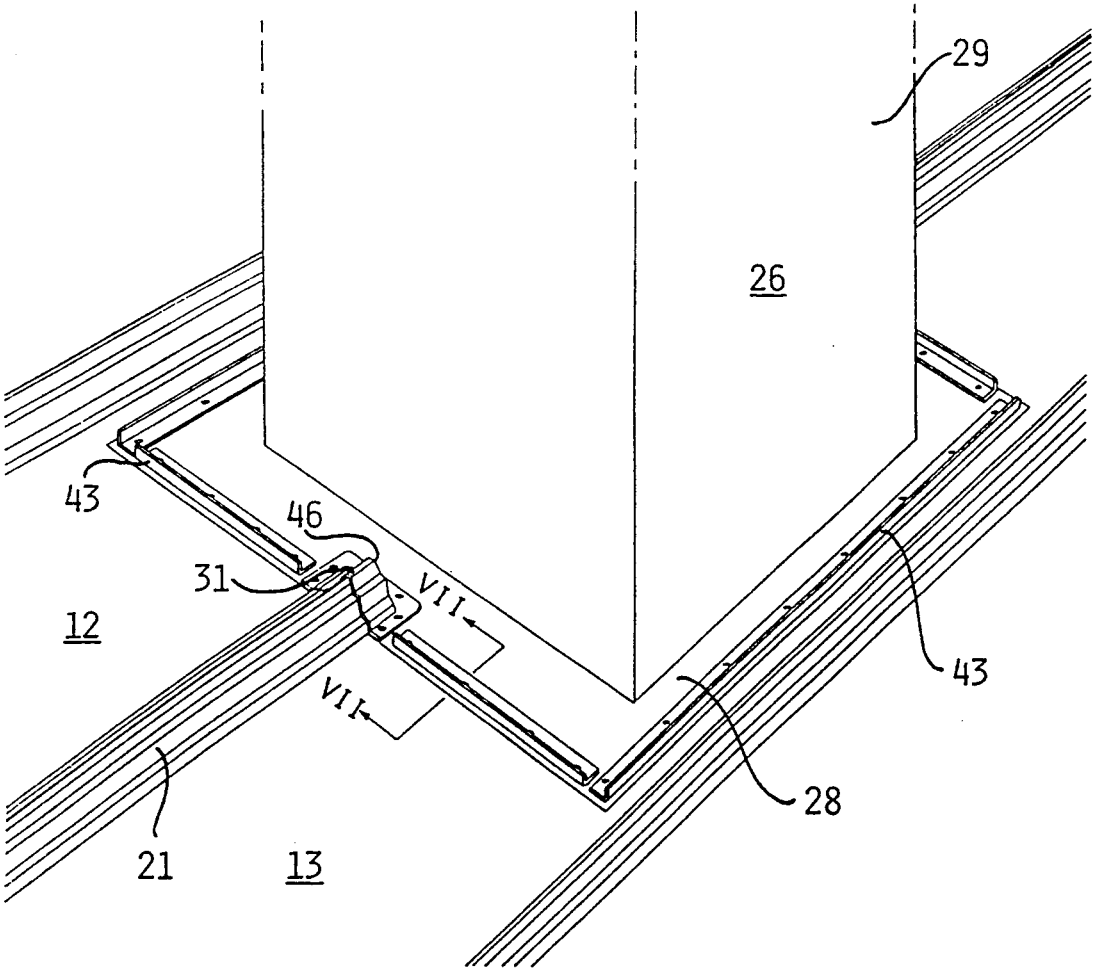
FIG. 6 is an isometric view of a second embodiment of the invention, wherein angle shaped distribution strips have been employed to increase the rigidity of the installation.

In FIG. 6, there is shown an alternative embodiment of the invention, wherein distributing strips 43 are configured so as to have a generally right angled cross-section, and wherein cap member 31 is made of an aluminum profile provided with a squared-off closed end 46, as opposed to the rounded nose portion shown in the embodiment of FIGS. 1 and 2 which shows a cap of formed steel plate. In a further alternative embodiment of the invention, the squared-off closed end 46 may be configured to be inclined with respect to the roof deck when installed rather than perpendicular thereto as shown in FIG. 6.

Figure 7:
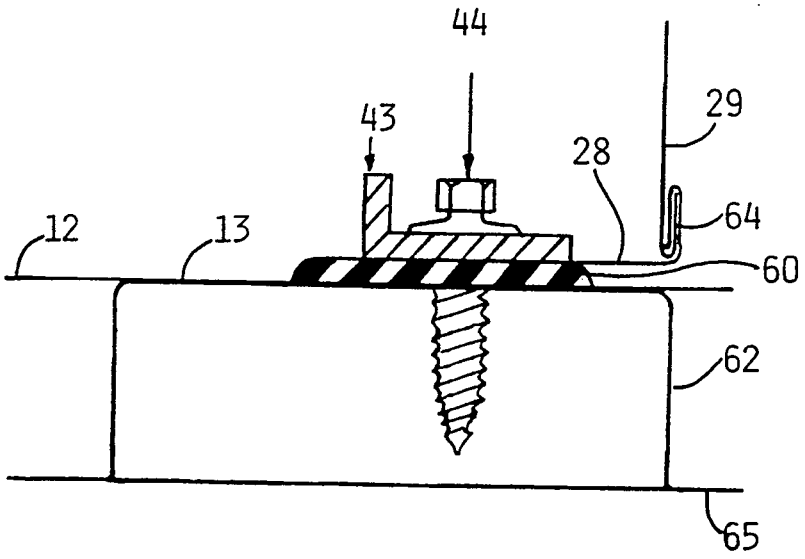
FIG. 7 is a cross-sectional view along the section VII—VII shown in FIG. 6.

Referring now to FIG. 7, in the alternative embodiment of FIG. 6, instead of the flat backing strips 33, 34 shown in FIG. 5, there are profiled (C-profile) backing members 62 which will take support against the underlying roof structure 65 and prevent the screws 44 from reaching the underlying roof structure 65. Thus, the roof panels will be lifted off the underlying roof structure 65 which, however, is no disadvantage.

The pressure distribution members 43 is also profiled and form together with the profiled backing member 43 a structure that is more rigid than the one shown in FIG. 5, which can be advantageous, particularly when the fitting 26 is wide.

In a particularly preferred embodiment, the width of roof panels 12 and 13 of pre-painted steel is on the order of 610 mm, and roof panels 12 and 13 weigh on the order of 6.0 $Kg/m^2$ and 3.6 Kg/linear meter. Additionally, in this embodiment, cap member 31 and backing members 33, 34, 35 have a thickness of from about 1.5 to about 2.5 mm, while roof members 12 and 13 are about 0.6 mm in thickness.

The invention as described hereinabove in the context of the preferred embodiments is not to be taken as limited to all of the provided details thereof, since modifications and variations thereof may be made without departing from the spirit and scope of the invention.

What is claimed is:

1. An arrangement for sealing an opening in a roof deck by mounting a baffle plate adjacent said roof deck so as to provide a throughgoing ducting channel through said roof deck, said roof deck having first and second surfaces and comprising a plurality of panels joined edgewise by at least one raised seam joint projecting from said first surface of said roof deck, said at least one raised seam joint having a longitudinal direction along the length thereof, said opening in said roof deck intersecting said at least one raised seam joint at at least one position, said baffle plate being provided with throughgoing ducting means for defining a passage therethrough, said baffle plate for being mountable on said first surface of said roof deck in a plurality of positions along a line which is substantially transverse to the longitudinal direction of said at least one raised seam joint, said baffle plate for being dimensioned such that, when said baffle plate is placed on one of said first and second surfaces of said panels of said roof deck, said baffle plate extends beyond the periphery of said opening in said panels of said roof deck to thereby define a zone of overlap of said baffle plate with said panels of said roof deck, said zone of overlap extending around a substantial portion of the periphery of said opening in said panels of said roof deck, and said baffle plate for being configured for the removal of a portion thereof to provide an opening in said baffle plate which partially surrounds said at least one raised seam joint, said arrangement comprising:

capping means for capping and sealing an area of convergence of: said baffle plate, said at least one raised seam joint and said opening in said panels;

said capping means being configured for being positioned over and at least partially surrounding a portion of said at least one raised seam joint; and said capping means being separate from and nonintegral with said baffle plate, said capping means being configured for being mountable at a plurality of locations with respect to a baffle plate;

backing and stiffening means for being positioned against said second surface of said panels;

said backing and stiffening means for being positioned opposite said baffle plate when said baffle plate is positioned against said first surface of said panels;

said backing and stiffening means also for being positioned at least partially within said zone of overlap; and fastening means for extending through and securing together: said capping means, said baffle plate, said panels and said backing and stiffening means within said zone of overlap.

2. The arrangement for sealing an opening in a roof deck according to claim 1, wherein said at least one raised seam joint has an at least partially hollow interior opening onto said second surface of said roof deck, wherein said backing and stiffening means comprises at least one backing member, said at least one backing member comprising two planar portions for being positioned against said second surface of said roof deck and at least partially within said zone of overlap on opposing sides of said at least one raised seam joint, said at least one backing member additionally comprising an upstanding portion disposed between said two planar portions, said upstanding portion being shaped and dimensioned to project into said at least partially hollow interior of said at least one raised seam joint from said second side of said roof deck to thereby support and stiffen the portion of said at least one raised seam joint adjacent said opening in said roof deck.

3. The arrangement for sealing an opening in a roof deck according to claim 2, wherein said at least one backing member comprises a backing plate having at least one tab portion formed therefrom, said tab portion projecting to form said upstanding portion.

4. The arrangement for sealing an opening in a roof deck according to claim 3, wherein said interior hollow portion of said at least one raised seam joint is defined by an interior surface and wherein said at least one tab portion is shaped and dimensioned so to substantially conform to said interior surface of said at least one raised seam joint.

5. The arrangement for sealing an opening in a roof deck according to claim 4, wherein said interior surface of said at least one raised seam joint and said at least one tab portion are each provided with a plurality of corresponding angularly related surfaces.

6. The arrangement for sealing an opening in a roof deck according to claim 4, said arrangement further comprising an elastomeric material for being positioned between said capping means and said at least one raised seam joint.

7. The arrangement for sealing an opening in a roof deck according to claim 2, wherein said backing and stiffening means additionally comprises a plurality of backing strips for contacting said second side of said roof deck in at least said zone of overlap, and wherein said arrangement additionally comprises a plurality of distributing strips for holding said baffle plate in at least said zone of overlap and further fastening means for extending through and securing together said distributing strips, said baffle plate, said roof deck and said backing strips.

8. The arrangement for sealing an opening in a roof deck according to claim 7, said arrangement further comprising an elastomeric material for being positioned between said baffle plate and one surface of said roof deck.

9. The arrangement for sealing an opening in a roof deck according to claim 8, said arrangement further comprising an elastomeric material for being positioned between said capping means and said at least one raised seam joint.

10. The arrangement for sealing an opening in a roof deck according to claim 7, wherein said plurality of distributing strips each have a substantially angle-shaped cross section.

11. The arrangement for sealing an opening in a roof deck according to claim 7, said arrangement further comprising an elastomeric material for being positioned between said capping means and said at least one raised seam joint.

12. The arrangement for sealing an opening in a roof deck according to claim 7, said arrangement further comprising an elastomeric material for being positioned between said baffle plate and said first surface of said roof deck.

13. The arrangement for sealing an opening in a roof deck according to claim 2, said arrangement further comprising an elastomeric material for being positioned between said capping means and said at least one raised seam joint.

14. The arrangement for sealing an opening in a roof deck according to claim 2, wherein said backing an stiffening means additionally comprises a plurality of backing strips for contacting said second side of said roof deck in at least said zone of overlap, and wherein said arrangement additionally comprises a plurality of distributing strips for contacting said baffle plate in at least said zone of overlap and further fastening means for extending through and securing together said distributing strips, said baffle plate, said roof deck and said backing strips.

15. An arrangement for sealing an opening in a roof deck by mounting a baffle plate in said roof deck so as to provide a throughgoing ducting channel through said roof deck, said roof deck having first and second surfaces and comprising a plurality of panels joined edgewise by at least one raised seam joint projecting from said first surface of said roof deck, said at least one raised seam joint having a longitudinal direction along the length thereof, said opening in said roof deck intersecting said at least one raised seam joint at at least one portion, said baffle plate being provided with throughgoing means for defining a passage therethrough, said baffle plate for being mountable on said first surface of said roof deck in a plurality of positions along a line which is substantially transverse to the longitudinal direction of said at least one raised seam joint, said baffle plate for being dimensioned such that, when said baffle plate is placed on one of said first and second surfaces of said panels of said roof deck, said baffle plate extends beyond the periphery of said opening in said roof deck in at least one direction to thereby define a zone of overlap of said baffle plate with said panels of said roof deck, said zone of overlap extending around a substantial portion of the periphery of said opening in said panels of said roof deck, and said baffle plate for being configured for the removal of a portion thereof to provide an opening in said baffle plate which partially surrounds said at least one raised seam joint, said arrangement comprising:

capping means for capping and sealing an area of convergence of: said baffle plate, said at least one raised seam joint and said opening in said panels;

said capping means for being positioned over at least partially surrounding a portion of said at least one raised seam joint; and said capping means being separate from and nonintegral with said baffle plate, said capping means for being mounted at a plurality of locations with respect to said baffle plate;

an elastomeric material for being positioned between said capping means and said at least one raised seam joint;

backing and stiffening means for being positioned against said roof deck opposite said baffle plate, said backing and stiffening means comprising a single integral plate; and fastening means for extending through and securing together: said capping means, said baffle plate, said backing and stiffening means and said panels within said zone of overlap.

16. The arrangement for selaing an opening in a roof deck according to claim 15, said arrangement further comprising an elastomeric material for being positioned between said baffle plate and said first surface of said roof deck.

17. A method for sealing an opening in a roof deck so as to provide a throughgoing ducting channel through said roof deck, said roof deck having first and second surfaces and comprising a plurality of panels joined edgewise by at least one raised seam joint projecting from said first surface of said roof deck, said at least one raised seam joint having a longitudinal direction along the length thereof, said opening in said roof deck intersecting said at least one raised seam joint at at least one portion, said method comprising the steps of:

providing a baffle plate, said baffle plate being provided with throughgoing ducting means for defining a passage therethrough, said baffle plate for being mountable on said first surface of said roof deck in a plurality of positions along a line which is substantially transverse to the longitudinal direction of said at least one raised seam joint, said baffle plate for being dimensioned such that, when said baffle plate is placed on one of said first and second surfaces of said panels of said roof deck, said baffle plate extends beyond the periphery of said opening in said panels of said roof deck in substantially all directions to thereby define a zone of overlap of said baffle plate with said panels of said roof deck, said zone of overlap extending around a substantial portion of the periphery of said opening in said panels of said roof deck, and said baffle plate for being configured for the removal of a portion thereof to provide an opening in said baffle plate which partially surrounds said at least one raised seam joint;

reducing said baffle plate in said at least one dimension of extension about said intersecting of said opening in said roof deck and said at least one raised seam joint;

fitting said baffle plate against said first surface of said roof deck such that said reduced dimension of said baffle plate partially surrounds said at least one raised seam joint at said intersection of said at least one raised seam joint and said opening in said roof deck;

installing capping means for capping and sealing an area of convergence of: said baffle plate, said at least one raised seam joint and said opening in said panels;

said capping means for being positioned over and at least partially surrounding a portion of said at least one raised seam joint; and said capping means being separate from and nonintegral with said baffle plate, said capping means for being mounted at a plurality of locations with respect to said baffle plate;

positioning backing and stiffening means against said second surface of said panels, opposite said baffle plate when positioned against said first surface of said panels;

said backing and stiffening means being at least partially disposed within said zone of overlap; and securing fastening means for extending through and securing together: said capping means, said baffle plate, said panels and said backing and stiffening means within said zone of overlap.

18. The method for sealing an opening in a roof deck according to claim 17, said method additionally comprising the step of positioning and securing an elastomeric sealing material between said capping means and said at least one raised seam joint.

19. A method for sealing an opening in a roof deck so as to provide a throughgoing ducting channel through said roof deck, said roof deck having first and second surfaces and comprising a plurality of panels joined edgewise by raised seam joints, said raised seam joints comprising snaplock arrangements, said raised seam joints having a longitudinal direction along the length thereof, and said opening in said roof deck intersecting at least one of said raised seam joints at at least one portion, said method comprising the steps of:

providing a baffle plate, said baffle plate being provided with throughgoing ducting means for defining a passage therethrough, said baffle plate for being mountable in a plurality of positions along a line which is substantially transverse to the longitudinal direction of said raised seam joints, said baffle plate being dimensioned such that, when said baffle plate is placed on said panels of said roof deck, said baffle plate extends beyond the periphery of said opening in said panels of said roof deck in substantially all directions to thereby define a zone of overlap of said baffle plate with said panels of said roof deck, said zone of overlap extending around a substantial portion of the periphery of said opening in said panels of said roof deck, and said baffle plate being configured for the removal of a portion thereof to provide an opening in said baffle plate which partially surrounds said at least one raised seam joint;

reducing said baffle plate in said at least one dimension of extension about said intersection of said opening in said roof deck and said at least one raised seam joint;

fitting, sealing, and securing said baffle plate against said roof deck such that said reduced dimension of said baffle plate partially surrounds said at least one raised seam joint and said opening in said roof deck;

cutting away a portion of said snaplock arrangement at said at least one raised seam joint at the end of said seam joint adjacent said opening in said roof deck;

installing capping means for capping and sealing an area of convergence of said baffle plate, said at least one raised seam joint and said opening in said panels such that said capping means covers the snaplock locking part of the raised seam.

* * * * *

UNITED STATES PATENT AND TRADEMARK OFFICE

CERTIFICATE OF CORRECTION

PATENT NO. : 5,027,576

DATED : July 2, 1991

INVENTOR(S) : Lars Ake Gustavsson

It is certified that error appears in the above-identified patent and that said Letters Patent is hereby corrected as shown below:

In column 1, line 18, after 'Prior', insert --Art:--

In column 5, line 45, after 'strip', insert --19 so as to provide a weatherproof seal therebetween in the assemb--.

Column 11, line 13:

In Claim 17, line 33, after the first instance of 'said', delete "intersecting" and insert --intersection--.

Column 11, line 37:

In Claim 19, line 37, after 'joint', insert --at said intersection of said at least one raised seam joint--.

Signed and Sealed this

Twentieth Day of October, 1992

*Attest:*

DOUGLAS B. COMER

*Attesting Officer*

*Acting Commissioner of Patents and Trademarks*